United States Patent [19]

Snow

[11] 4,234,977

[45] Nov. 25, 1980

[54] COT

[76] Inventor: Bill D. Snow, 3817 Rutledge, Fort Worth, Tex. 76107

[21] Appl. No.: 82,729

[22] Filed: Oct. 9, 1979

Related U.S. Application Data

[63] Continuation of Ser. No. 934,392, Aug. 17, 1978, abandoned.

[51] Int. Cl.[3] ..... A47C 17/14; A47F 1/00; A47K 3/22

[52] U.S. Cl. ..... 5/110; 4/585; 5/82 R; 5/419; 9/348; 297/239; 297/457

[58] Field of Search ..... 5/82 R, 94, 99, 110, 5/111, 186, 400, 419, 420; 4/177, 185 HB; 297/DIG. 2, 456, 457; D23/52; 9/348

[56] References Cited

U.S. PATENT DOCUMENTS

| | | | |
|---|---|---|---|
| 2,828,489 | 4/1958 | Baker | 297/457 |
| 2,936,826 | 5/1960 | Reinemar | 297/457 |
| 2,957,184 | 10/1960 | Smith | 297/457 |
| 3,633,222 | 1/1972 | Greenfield | 297/457 |
| 3,729,752 | 5/1973 | Huggins | 5/93 R |
| 3,835,482 | 9/1974 | Tersch | 9/348 |

FOREIGN PATENT DOCUMENTS

| | | | |
|---|---|---|---|
| 1342629 | 1/1974 | United Kingdom | 5/419 |

*Primary Examiner*—Casmir A. Nunberg
*Attorney, Agent, or Firm*—Wofford, Fails & Zobal

[57] ABSTRACT

A light weight, one piece molded cot which has a contoured sleeping surface with four downward extending walls for supporting the sleeping surface above the floor. The bottom edges of the side walls flange outward and trap air below the cot.

15 Claims, 5 Drawing Figures

Fig. 1
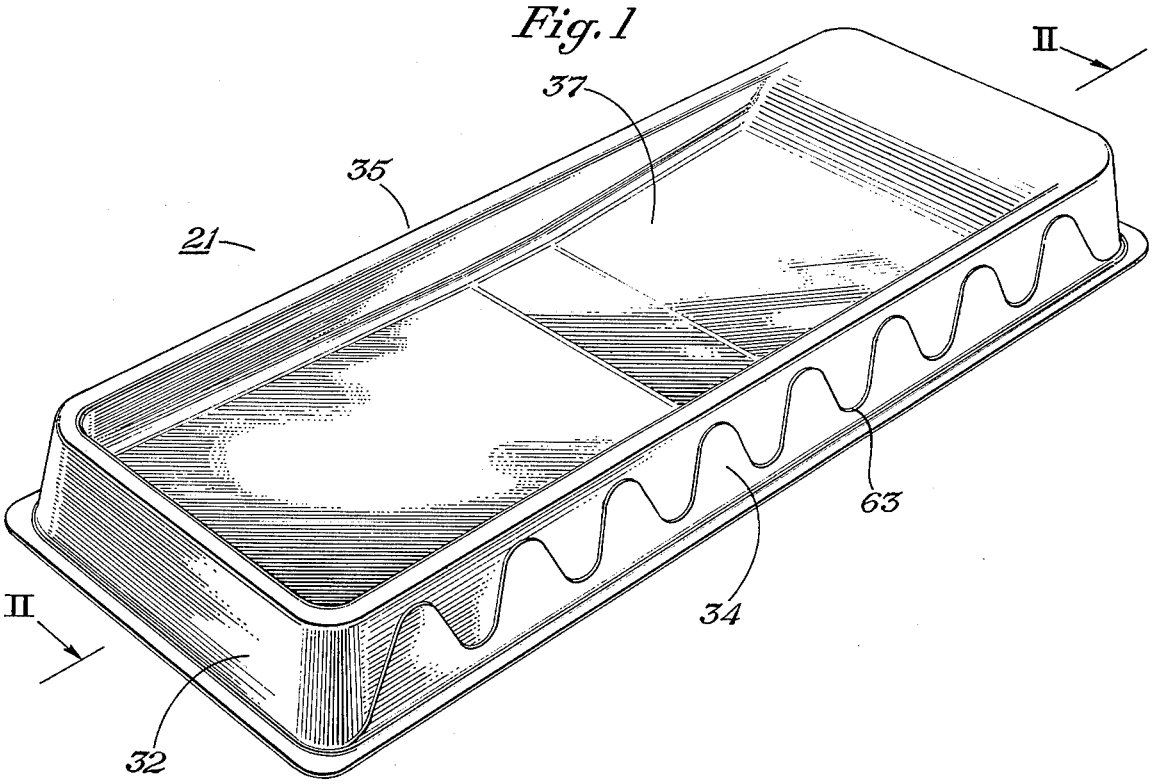
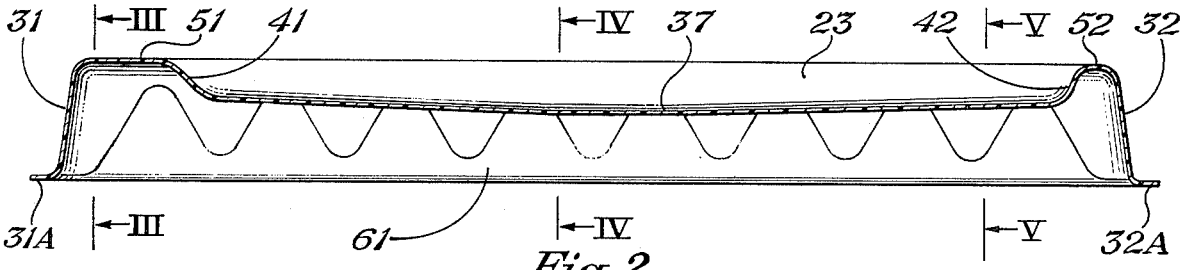
Fig. 2
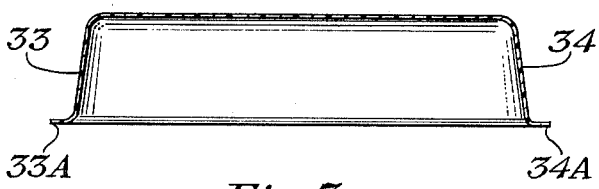
Fig. 3
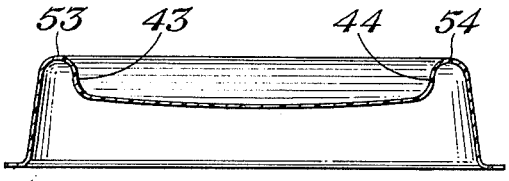
Fig. 4
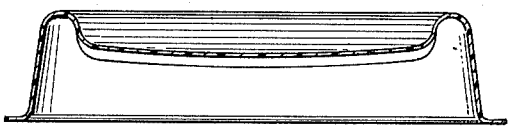
Fig. 5

COT

This is a continuation, of application Ser. No. 934,392, filed Aug. 17, 1978, now abandoned.

BACKGROUND OF THE INVENTION

Small children to age 9 in day care centers or other such facilities usually are required to take naps on mats laid on the floor or on conventional juvenile cots made with wood, steel, or aluminum frames with cloth fabric stretched between the frames for support purposes. Sleeping on the floor can be uncomfortable and cold while conventional cots are costly, having several pieces held together by fasteners which become a hazard and require maintenance. Handling and stacking also is a problem with conventional cots since they require a great amount of storage space when not in use. In addition, another problem in the use of conventional cots results from the wetting by juveniles which causes odors and unsanitary conditions. Cleaning conventional cots by washing and air drying requires much time and renders the cots unusable for extended periods of time while drying.

SUMMARY OF THE INVENTION

It is an object of the present invention to provide a cot which is attractive to children, light weight, comfortable, economic, easy to clean, and which requires less space than the conventional cot and which also may be readily stacked in a minimum amount of space with other such cots when not in use.

The cot comprises a one piece molded member having a rectangular shaped upward facing sleeping surface connected to a surrounding ridge and four side walls extending downward from the ridge for supporting the sleeping surface above the floor. The lower edges of the side walls flange outward in a flat plane. The ridge at one end of the cot has surface dimensions sufficient to form a head rest for a person lying on the sleeping surface.

BRIEF DESCRIPTION OF THE DRAWINGS

FIG. 1 is a perspective view of the cot of the present invention;

FIG. 2 is a cross-section of FIG. 1 taken along the lines 2—2 thereof;

FIG. 3 is a cross-section of FIG. 2 taken along the lines 3—3 thereof;

FIG. 4 is a cross-section of FIG. 2 taken along the lines 4—4 thereof; and FIG. 5 is a cross-section of FIG. 2 taken along the lines 5—5 thereof.

DETAILED DESCRIPTION OF THE INVENTION

Referring now to the drawings, the cot of the present invention is identified by reference numeral 21 and is a one piece member molded from a thin sheet of plastic. The cot comprises a generally rectangular shaped top wall structure 23 having four supporting side walls 31, 32, 33 and 34 extending downward from the top wall structure. The four supporting side walls have bottom edges 31A, 32A, 33A and 34A which flange outward in a flat plane for engaging the floor of a house or building for supporting the top wall structure 23 above and spaced from the floor. The four supporting side walls are integral with the top wall structure 23 and adjacent side walls are integral with each other such that the cot when supported on the floor in the manner shown in FIG. 1 forms an air cushion. The top wall structure 23 comprises a ridge 35 surrounding a rectangular shaped upward facing sleeping surface 37 which is located at a level between the upper edge of the ridge 35 and bottom edges 31A–34A. The sleeping surface 37 is supported by the ridge 35 which comprises four inner side wall portions 41, 42, 43 and 44, the upper edges of which are connected to the upper edges of the side walls 31–34 by way of upper wall portions 51, 52, 53 and 54 respectively. As seen in the drawings, the wall portions 52–53 are narrow rounded portions while the wall portion 51 is flat forming a head rest for the person lying on the sleeping surface 37. The surface 37 also slopes downward towards the center from all four sides forming a comfortable and resilient sleeping surface. The sleeping surface 37 with the four supporting inner walls 41–44 in effect define a supporting cradle which is waterproof. It is noted further that the four side walls 31–34 flare outward whereby several cots may be stacked together, one nested within the other. Nesting is carried out by inserting the top of one cot within the bottom opening 61, formed between the side walls, of another cot.

In one embodiment, the cot has a width of 24 inches, a length of 53½ inches and height of 5½ inches. The head rest 51 has dimensions of about 20 inches by 5 inches. Ridges 63 are for structural support purposes although they form a pleasing design. They are not illustrated in FIGS. 3–5. The cot is formed by vacuum molding of a sheet of thermoplastic such as ABS, styrene, polyethylene, polypropylene, etc. The cot could also be injection molded. The walls have a thickness of about 1/16th of an inch and the total weight of the cot is 6½ pounds. Although the walls are thin and flexible and the unit is light in weight, it has been found that the cot will support more than 8 times the weight of an average child.

Since the cots are light weight, stacking may be carried out easily by the children themselves. Fifty cots may be stacked in less than 30 inches. Thus, it can be seen that the cots may be stored in a minimum amount of space when not in use. When the cots are stacked the sleeping surfaces do not touch. It has been found that each cot takes up 12% less floor space than the conventional cot thereby providing more potential accommodations for children on existing floor space. The cots are sturdy and stable and require no screws or bolts, legs or other parts that require replacement or maintenance. Thus, there are no parts to wear out and no parts to mar the floor. The cot may be readily cleaned by wiping with a mild detergent. By forming the cot as a one piece molded member, the cot can be sold for ⅓ less than the cost of a conventional cot. In use the cot is merely placed on the floor with its flanges 31A–34A engaging the floor surface. In this position, the cot traps dead air underneath for warmth and draft free use. Although the cot is quite comfortable without pads or sheets, they can be easily used if so desired. The head rest 51 and contour design cradle the child in secure cushioned comfort. Since the cot is lower to the floor, it has been found that it is a new and fun experience for children. Moreover, the low profile makes it safer than the conventional cot since there are no protruding legs or metal frames to trip over or collide with. The children may fit their shoes under the cot so as to remove additional tripping hazards.

What is claimed is:

1. A one piece molded cot or the comprising:

a generally rectangular shaped top wall means having two straight sides and two straight ends, said two straight sides being straight over substantially the entire distance between said two straight ends, said two straight ends being straight over substantially the entire distance between said said two straight sides, a straight supporting side wall extending downward from each side and from each end of said top wall means, said supporting sides walls having bottom edges spaced from said top wall means and which flange outward in a plane for engaging the floor of a house or building for supporting said top wall means above and spaced from the floor, said top wall means comprises:

a ridge surrounding a rectangular shaped upward facing surface for supporting a person and which surface is located at a level between the upper edge of said ridge and said bottom edges of said supporting side walls, four inner side wall portions extending upward from said upward facing surface, said ridge being defined by ridge wall portions connecting the upper edges of said inner side wall portions with the upper edges of said supporting side walls respectively.

2. The cot of claim 1 wherein:

said four inner side walls are integral with said upward facing surface defining a waterproof cradle for supporting a person.

3. The cot of claim 1 wherein:

said four supporting side walls are integral with said top wall means and adjacent supporting side walls are integral with each other such that said cot when supported on a flat surface by said supporting side walls forms an air cushion.

4. The cot of claim 1 wherein:

said rectangular shaped top wall means has a length greater than its width, one of said ridge wall portions along the width of said rectangular shaped top wall means having a flat upper surface with dimensions sufficient to form a head rest for a person lying on said rectangular shaped upward facing surface.

5. The cot of claim 3 wherein:

said rectangular shaped top wall means has a length greater than its width, one of said ridge wall portions along the width of said rectangular shaped top wall means having a flat upper surface with dimensions sufficient to form a head rest for a person lying on said rectangular shaped upward facing surface.

6. The cot of claim 5 wherein:

said four supporting side walls flare outward whereby two of said cots may be stacked together, one nested within the other.

7. The cot of claim 5 wherein:

the walls thereof are thin and flexible and are formed of a hard thermoplastic material.

8. A cot in the form of an integral one-piece body molded of hard thermoplastic material and configured so as to provide sufficient strength to support several times the weight of an occupant and yet permit a substantially uniform wall thickness sufficiently thin that the cot is light in weight and flexible for comfort; said body comprising:

a. a top wall means of generally rectangular shape having two straight sides and two straight ends, said two straight sides being straight over substantially the entire distance between said two straight ends, said two straight ends being straight over substantially the entire distance between said two straight sides, with said top wall means forming a generally rectangular shaped ridge having upper wall portions which have a continuously curving transverse section except the upper wall portion at one end which has a generally flat portion with dimensions sufficient to form a head rest, and with the upper extremity of said ridge of said top wall means being tangent to a first plane;

b. a straight supporting sidewall merging with and depending from each side and from each end of said top wall means tapering slightly outward in a downward direction, with each said support sidewall merging with adjacent support sidewalls in a continuously curving manner, with said support sidewalls having bottom edges spaced from said top wall means and which flange outward for engaging the floor of a house or building in a plane generally parallel to said first plane for supporting said top wall means above and spaced from the floor, and with the juncture of said bottom edges and the rest of said support sidewalls having a continuous curvature;

c. a web portion providing an upward facing surface for supporting a person and disposed generally at a level between said ridge upper wall portions and the bottom edges of said supporting sidewalls;

d. said ridge of said top wall means further comprising inner sidewall portions merging at their upper edges with and depending from said upper wall portions and merging at their lower edges with said web at the periphery thereof in a continuously curving manner.

9. The cot of claim 8 wherein:

said support sidewalls that depend from the two straight sides of said top wall means are provided with reinforcing means.

10. The cot of claim 9 wherein:

the reinforcing means for said support sidewalls comprises the dividing of a said sidewall into two portions which are offset such that each has a generally planar surface and these planar surfaces are parallel and spaced a small distance apart and said two portions are joined by an intermediate portion which undulates as it traverses along the length of a said support sidewall;

said web portion having a slightly concave shape in transverse section and having a slight upward taper from a central region toward each end.

11. The cot of claim 9 wherein:

the reinforcing means for said support sidewalls comprises the dividing of a said sidewall into portions which are offset one from another such that each has a generally planar surface and these planar surfaces are parallel and spaced a small distance apart and said offset portions are joined by intermediate portions and all changes of direction of the juncture are accomplished by curvature.

12. A cot in the form of an integral one-piece body molded of hard thermoplastic material and configured so as to provide sufficient strength to support several times the weight of an occupant and yet permit a substantially uniform wall thickness sufficiently thin that the cot is light in weight and flexible for comfort; said body comprising:

a. a top wall means of generally rectangular shape having two straight sides and two straight ends, said two straight sides being straight over substantially the entire distance between said two straight ends, said two straight ends being straight over substantially the entire distance between said two straight sides, with said top wall means forming a generally rectangular shaped ridge having upper wall portions which have a continuously curving transverse section except the upper wall portion at one end which has a relatively wide portion with dimensions sufficient to form a head rest;

b. a straight supporting sidewall merging with and depending from each side and from each end of said top wall means tapering slightly outward in a downward direction, with each said support sidewall merging with adjacent support sidewalls in a continuously curving manner, with said support sidewalls having bottom edges spaced from said top wall means and which flange outward for engaging the floor of a house or building for supporting said top wall means above and spaced from the floor;

c. a web portion providing an upward facing surface for supporting a person and disposed generally at a level between said ridge upper wall portions and the bottom edges of said supporting sidewalls;

d. said ridge of said top wall means further comprising inner sidewall portions merging at their upper edges with and depending from said upper wall portions and merging at their lower edges with said web at the periphery thereof in a continuously curving manner.

13. The cot of claim 12 wherein:

the upper extremity of said ridge of said top wall means is tangent to a first plane, said supporting sidewalls having bottom edges spaced from said top wall means and which flange outward for engaging the floor of a house or building in a plane generally parallel to said first plane.

14. A one piece molded cot or the like, comprising:

a generally rectangular shaped top wall means having a length greater than its width, said rectangular shaped top wall means having two sides and two ends and a supporting sidewall extending downward from each side and from each end of said top wall means, said four supporting side walls having bottom edges spaced from said top wall means and which flange outward in a plane for engaging the floor of a house or building for supporting said top wall means above and spaced from the floor, said top wall means comprising:

a ridge surrounding a rectangular shaped upward facing surface for supporting a person and which surface is located at a level between the upper edge of said ridge and said bottom edges of said supporting side walls, four inner side wall portions extending upward from said upward facing surface, said ridge being defined by ridge wall portions connecting the upper edges of said inner side wall portions with the upper edges of said supporting side walls respectively, each end of said rectangular shaped upward facing surface at each end of said top wall means adjacent said ridge being generally at the same height above said plane.

15. The cot of claim 14 wherein:

one of said ridge wall portions along the width of said rectangular shaped top wall means at one end has a width greater than said ridge wall portions along the length said top wall means and at the other end of said top wall means.

* * * * *